US008549676B1

(12) United States Patent
Mandel

(10) Patent No.: US 8,549,676 B1
(45) Date of Patent: Oct. 8, 2013

(54) COMBINATION PACKET CONTAINING DISPOSABLE SANITARY TOILET SEAT COVER AND MOIST WIPE

(76) Inventor: Scott J. Mandel, Oceanside, NY (US)

( * ) Notice: Subject to any disclaimer, the term of this patent is extended or adjusted under 35 U.S.C. 154(b) by 1309 days.

(21) Appl. No.: 11/355,534

(22) Filed: Feb. 16, 2006

(51) Int. Cl.
*A47K 13/14* (2006.01)

(52) U.S. Cl.
USPC ..... 4/245.1

(58) Field of Classification Search
USPC ..... 4/245.1, 245.4, 245.8, 245.9; 206/812
See application file for complete search history.

(56) References Cited

U.S. PATENT DOCUMENTS 2,241,171 A * 5/1941 Wallace ..... 4/245.8
3,129,811 A * 4/1964 Williams ..... 206/812 X
3,881,210 A * 5/1975 Drach et al. ..... 206/812 X
4,332,319 A 6/1982 Hurwood
4,796,751 A * 1/1989 Madkour ..... 206/812 X
4,875,242 A * 10/1989 Albrecht et al. ..... 4/245.4
4,881,278 A 11/1989 Farah
5,111,934 A * 5/1992 Morin ..... 206/812 X
5,242,057 A 9/1993 Cook et al.
6,073,274 A 6/2000 McQueen
6,446,795 B1 9/2002 Allen et al.
6,711,756 B1 3/2004 Mollendor
2004/0154949 A1 8/2004 Lenhard et al.

* cited by examiner

*Primary Examiner* — Lori Baker
(74) *Attorney, Agent, or Firm* — Bernard S. Hoffman

(57) ABSTRACT

A combination packet containing disposable sanitary toilet seat cover and moist wipe which comprises a flexible enclosure having a first dry compartment and a second vapor moist compartment therein. A sanitary toilet seat cover is folded and carried within the first dry compartment of the flexible enclosure. A moist wipe is folded and carried within the second vapor moist compartment in the flexible enclosure.

16 Claims, 1 Drawing Sheet

COMBINATION PACKET CONTAINING DISPOSABLE SANITARY TOILET SEAT COVER AND MOIST WIPE

BACKGROUND OF THE INVENTION

1. Field of the Invention

The present invention relates to a personal hygiene product, and more particularly, a combination packet containing disposable sanitary toilet seat cover and moist wipe.

2. Description of the Prior Art

Numerous innovations for sanitary components have been provided in the prior art that will be described. Even though these innovations may be suitable for the specific individual purposes to which they address, however, they differ from the present invention.

A FIRST EXAMPLE, U.S. Pat. No. 4,332,319, Issued on Jun. 1, 1982, to Hurwood teaches a hygienic product for cleaning parts of the body comprising a moistened napkin and a quantity of powder capable of absorbing moisture. The napkin is contained in a first air-tight envelope-like compartment of a packet, and the powder is contained in a second air-tight compartment of the packet. The two compartments may have a common wall between them, in which case each compartment has an outer wall opposite the common wall, whereby all three walls are tearable along a "tear-open" line simultaneously to open both compartments at the same time. The powder may be loose or, alternatively, may be carried by a soft pad or applicator contained within the second compartment.

A SECOND EXAMPLE, U.S. Pat. No. 4,881,278, Issued on Nov. 21, 1989, to Farah teaches a single-use unitary package for carrying toilet seat disinfecting/covering materials on the person. The package is constructed of flexible sheet material such as aluminum foil, sealed along edges and across the middle to form two compartments. One compartment holds a folded toilet seat cover and the other compartment holds a supply of toilet seat disinfectant.

A THIRD EXAMPLE, U.S. Pat. No. 5,242,057, Issued on Sep. 7, 1993, to Cook et al. teaches a personal care convenience kit which dispenses different personal hygiene components in a sequential, one at a time fashion through a single dispensing opening. The convenience kit includes a compliant package having a first dispensing opening, and at least two different personal hygiene components ordered with respect to the first dispensing opening. The compliant package can include an auxiliary dispensing opening for dispensing at least one of the different components out of sequence.

A FOURTH EXAMPLE, U.S. Pat. No. 6,073,274, Issued on Jun. 13, 2000, to McQueen teaches a sanitary toilet seat cover for preventing direct contact between a person's skin and the top surface of a toilet seat. The toilet seat cover includes a top layer of waterproof material whose underside is affixed to a layer of porous material impregnated with an antibacterial solution. The porous layer is provided with a plurality of adhesive patches to temporarily affix the seat cover to a toilet seat and a bottom layer of waterproof material whose peripheral edges are sealingly engaged with the underside of the top layer of waterproof material to provide an airtight envelope that surrounds the antibacterial solution until the toilet seat cover is ready for use.

A FIFTH EXAMPLE, U.S. Pat. No. 6,446,795 B1, Issued on Sep. 10, 2002, to Allen et al. teaches a packaged towelette including a flexible sheet material sealed around a pre-moistened towelette, the flexible sheet material including a fin constructed to allow a user to grasp the fin and open the package without touching the towelette.

A SIXTH EXAMPLE, U.S. Pat. No. 6,711,756 B1, Issued on Mar. 30, 2004, to Mollendor teaches a toilet seat cover that includes a sheet of impermeable material and at least one section of adhesive material. The section of adhesive material having an upper surface and a lower surface, the lower surface of the section of adhesive material being attached to the sheet of impermeable material using an adhesive of a high peel strength that prevents the section of adhesive material from being easily removed from the sheet of impermeable material. The upper surface of the section of adhesive material having an adhesive of a low peel strength, so that the sheet may be folded upon itself to cover the upper surface of section of adhesive material, so that unfolding of the sheet of impermeable material exposes the upper surface of the section of adhesive material, so that the upper surface of the section of adhesive material may then be placed on the surface of a toilet seat to retain the toilet seat cover over the toilet seat.

A SEVENTH EXAMPLE, U.S. Patent Office Document No. 2004/0154949 A1, Published on Aug. 12, 2004, to Lenhard et al. teaches a pack of toilet seat covers adapted to be received in a dispenser that includes a group of toilet seat covers and a package for containing the group of covers. The package includes an insert. The package further includes a wrapper for enclosing the insert and the group of covers when the package is assembled. The wrapper is made from a lightweight, flexible material. The wrapper has a window portion that is removable to enable access to the group of covers within the wrapper when the package is received in a dispenser.

It is apparent now that numerous innovations for sanitary components have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a combination packet containing disposable sanitary toilet seat cover and moist wipe that avoids the disadvantages of the prior art.

ANOTHER OBJECT of the present invention is to provide a combination packet containing disposable sanitary toilet seat cover and moist wipe that is simple and inexpensive to manufacture.

STILL ANOTHER OBJECT of the present invention is to provide a combination packet containing disposable sanitary toilet seat cover and moist wipe that is simple to use.

BRIEFLY STATED, STILL YET ANOTHER OBJECT of the present invention is to enable and facilitate a hygienic procedure for utilizing a toilet which is accomplish by providing a combination packet containing a disposable sanitary toilet seat cover and moist wipe which comprises a flexible enclosure having a first dry compartment and a second vapor moist compartment therein. The sanitary toilet seat cover is folded and carried within the first dry compartment of the flexible enclosure and the moist wipe is folded and carried within the second vapor moist compartment in the flexible enclosure.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALLING OF REFERENCE NUMERALS UTILIZED IN THE DRAWING

Figure 2:
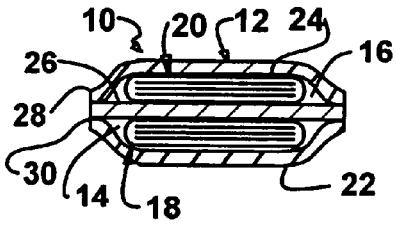
FIG. 2 is a diagrammatic cross sectional view taken on line 2-2 of FIG. 1 showing the sanitary toilet seat cover and moist wipe folded within the packet.

10 combination packet
12 flexible enclosure of combination packet 10
14 first dry compartment in flexible enclosure 12
16 second vapor moist compartment in flexible enclosure 12
18 sanitary toilet seat cover of combination packet 10
20 moist wipe of combination packet 10
22 first outer wall of flexible enclosure 12
24 second outer wall of flexible enclosure 12
26 central common wall of flexible enclosure 12
28 moisture impregnable sheet material of flexible enclosure 12
30 peripheral edge of flexible enclosure 12
32 tear line of flexible enclosure 12
34 rectangular dry sheet protective paper of sanitary toilet seat cover 18
36 beveled corner of rectangular dry sheet protective paper 34
38 toilet seat on typical toilet 40
40 typical toilet
42 latitudinal fold line of sanitary toilet seat cover 18
44 longitudinal fold line of sanitary toilet seat cover 18
46 central flush flap in sanitary toilet seat cover 18
48 temporarily securing mechanism for sanitary toilet seat cover 18
50 rear surface on sanitary toilet seat cover 18
52 pressure sensitive adhesive pad of temporarily securing mechanism 48
54 peel-off release sheet on pressure sensitive adhesive pad 52
56 sheet of fibrous material for moist wipe 20
58 suitable germicidal liquid in sheet of fibrous material 56
60 fold line in moist wipe 20

DETAILED DESCRIPTION OF THE PREFERRED EMBODIMENT

Figure 1:
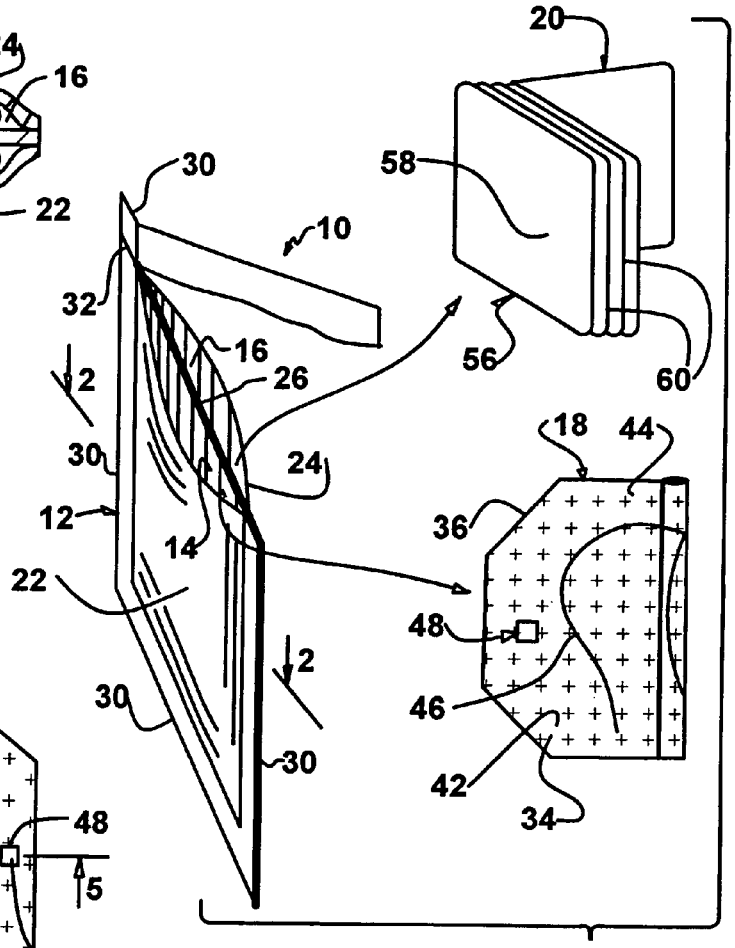
FIG. 1 is a diagrammatic perspective view of the present invention showing the sanitary toilet seat cover and moist wipe removed from the packet and starting to be unfolded.

Referring now to the figures, in which like numerals indicate like parts, and particularly to FIGS. 1 and 2, which are a diagrammatic perspective view of the present invention showing the sanitary toilet seat cover and moist wipe removed from the packet and starting to be unfolded; and a diagrammatic cross sectional view taken on line 2-2 of FIG. 1 showing the sanitary toilet seat cover and moist wipe folded within the packet, and as such, will be discussed with reference thereto.

The present invention is a combination packet 10, which comprises a flexible enclosure 12 having a first dry compartment 14 and a second vapor moist compartment 16 therein. A sanitary toilet seat cover 18 is folded and carried within the first dry compartment 14 of the flexible enclosure 12. A moist wipe 20 is folded and carried within the second vapor moist compartment 16 in the flexible enclosure 12. The flexible enclosure 12 includes a first outer wall 22, a second outer wall 24 and a central common wall 26 to form the first dry compartment 14 and the second vapor moist compartment 16 in a side-by-side relationship therein.

The first outer wall 22, the second outer wall 24 and the central common wall 26 of the flexible enclosure 12 are fabricated from a moisture impregnable sheet material 28. The first outer wall 22, the second outer wall 24 and the central common wall 26 of the flexible enclosure 12 includes peripheral edges 30 that are sealed together in an air-tight manner. The flexible enclosure 12 includes a tear line 32 across one of the peripheral edges 30 of the first outer wall 22, the second outer wall 24 and the central common wall 26. When the tear line 32 is torn, both the first dry compartment 14 and the second vapor moist compartment 16 will be opened simultaneously, to allow removal and unfolding of the sanitary toilet seat cover 18 and the moist wipe 20 for use.

Figure 4:
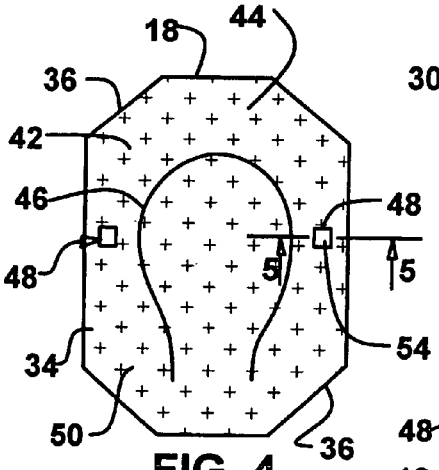
FIG. 4 is a diagrammatic enlarged bottom view, taken in the direction of arrow 4 in FIG. 3, of the sanitary toilet seat cover.
Figure 3:
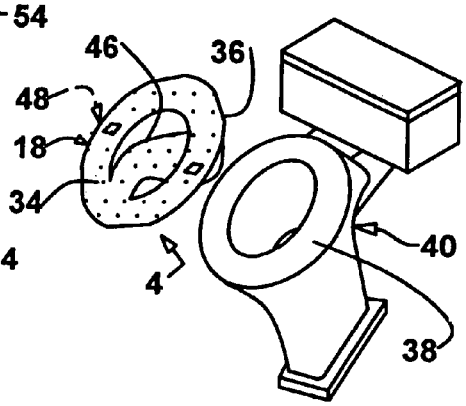
FIG. 3 is a diagrammatic perspective view showing the sanitary toilet seat cover unfolded and ready to be adhered to a toilet seat on a typical toilet.

The sanitary toilet seat cover 18 is shown in FIGS. 3 and 4, which are a diagrammatic perspective view showing the sanitary toilet seat cover unfolded and ready to be adhered to a toilet seat on a typical toilet; and a diagrammatic enlarged bottom view, taken in the direction of arrow 4 in FIG. 3, of the sanitary toilet seat cover; and as such, will be discussed with reference thereto.

The sanitary toilet seat cover 18 is fabricated out of a rectangular dry sheet protective paper 34, having four beveled corners 36 and sized to fit over a toilet seat 38 on a typical toilet 40. The rectangular dry sheet protective paper 34 of the sanitary toilet seat cover 18 includes a plurality of latitudinal fold lines 42 and a plurality of longitudinal fold lines 44, so that the sanitary toilet seat cover 18 can be folded up to fit into the first dry compartment 14 of the flexible enclosure 12.

The rectangular dry sheet protective paper 34 of the sanitary toilet seat cover 18 includes a central flush flap 46. The sanitary toilet seat cover 18 further includes a mechanism 48 on a rear surface 50 of the rectangular dry sheet protective paper 34, for temporarily securing the sanitary toilet seat cover 18 to the toilet seat 38 on the typical toilet 40.

Figure 5:
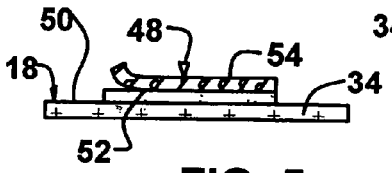
FIG. 5 is a diagrammatic further enlarged cross sectional view, with parts broken away, taken along line 5-5 in FIG. 4, showing the temporary securing mechanism on the sanitary toilet seat cover in greater detail.

The temporarily securing mechanism 48, as best seen in FIG. 5, is a diagrammatic further enlarged cross sectional view, with parts broken away, taken along line 5-5 in FIG. 6 4, showing the temporary securing mechanism on the sanitary toilet seat cover in greater detail, and as such, will be discussed with reference thereto.

The temporarily securing mechanism 48 consists of a plurality of pressure sensitive adhesive pads 52 secured to the rear surface 50 of the toilet seat cover. Each pressure sensitive adhesive pad 52 includes a peel-off release sheet 54, so that when the peel-off release sheet 54 is removed, the pressure sensitive adhesive pad 52 may be pressed onto the toilet seat 38 on the typical toilet 40 (see FIG. 4).

The moist wipe 20, as shown in FIG. 1, is fabricated out of a sheet of fibrous material 56. The sheet of fibrous material 56 of the moist wipe 20 us saturated with a suitable germicidal liquid 58, to clean sensitive areas of the skin of a person (not shown) using the typical toilet 40. The sheet of fibrous material 56 of the moist wipe 20 includes a plurality of fold lines 60, so that the moist wipe 20 can be folded up to fit into the second vapor moist compartment 16 in the flexible enclosure 12.

OPERATION OF THE INVENTION

To use the combination packet 10 the following steps should be taken:

1. Tear open the tear line 32 in the flexible enclosure 12.
2. Remove the folded sanitary toilet seat cover 18 from the first dry compartment 14.
3. Unfold the sanitary toilet seat cover 18 along the latitudinal fold lines 42 and the longitudinal fold lines 44.
4. Pull off the peel-off release sheet 54 from each pressure sensitive' adhesive pad 52.
5. Press the pressure sensitive adhesive pads 52 onto the toilet seat 38 on the typical toilet 40.
6. Sit on the sanitary toilet seat cover 18 to use the typical toilet 40
7. Remove the folded moist wipe 20 from the second vapor moist compartment 16.
8. Unfold the moist wipe 20 along the fold lines 60.
9. Use the moist wipe 20 with the suitable germicidal liquid 58 to clean the sensitive areas of the skin after using the typical toilet 40.

It will be understood that each of the elements described above, or two or more together, may also find a useful application in other types of constructions differing from the types described above.

While the invention has been illustrated and described as embodiments of a combination packet containing disposable sanitary toilet seat cover and moist wipe, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A packet, comprising:

a) an enclosure having a first compartment and a second compartment therein;

b) a sanitary toilet seat cover carried within said first compartment of said enclosure; and c) a moist wipe carried within, but not adhered to, said second compartment in said enclosure so as to be freely removable therefrom;

wherein said enclosure includes:

a) a first outer wall;

b) a second outer wall; and c) a common partition wall to form with said first outer wall and said second outer wall said first compartment and said second compartment in a side-by-side relationship;

wherein said moist wipe is saturated with a germicidal liquid;

wherein said germicidal liquid is for cleaning sensitive areas of the skin of a person using a typical toilet; and wherein both said first compartment and said second compartment are so configured so as to be opened simultaneously without a need for any external devices to open both said first compartment and said second compartment simultaneously, and when opened this way, said sanitary toilet seat cover and said moist wipe are freely removable from said first compartment and said second compartment, respectively, without a need for any external devices to remove both said sanitary toilet seat cover and said moist wipe from said first compartment and said second compartment, respectively.

2. The packet of claim 1, wherein said first outer wall, said second outer wall, and said common partition wall of said enclosure are fabricated from a sheet material.

3. The packet of claim 1, wherein said first outer wall, said second outer wall, and said common partition wall of said enclosure include peripheral edges; and wherein said peripheral edges of said first outer wall, said second outer wall, and said common partition wall of said enclosure are sealed together in an air-tight manner.

4. The packet of claim 3, wherein said enclosure includes a tear line; and wherein when said tear line of said enclosure is torn, both said first compartment and said second compartment are opened simultaneously to allow removal of said sanitary toilet seat cover and said moist wipe for use.

5. The packet of claim 1, wherein said sanitary toilet seat cover is fabricated out of a dry sheet protective paper; and wherein said dry sheet protective paper of said sanitary toilet seat cover is sized for fitting over a toilet seat of a typical toilet.

6. The packet of claim 5, wherein said dry sheet protective paper of said sanitary toilet seat cover includes a plurality of latitudinal fold lines and a plurality of longitudinal fold lines so as to allow said sanitary toilet seat cover to be folded up and fit into said first compartment of said enclosure.

7. The packet of claim 5, wherein said dry sheet protective paper of said sanitary toilet seat cover includes a generally central flap.

8. The packet of claim 1, wherein said sanitary toilet seat cover includes means for temporarily securing said sanitary toilet seat cover to a toilet seat of a typical toilet.

9. The packet of claim 8, wherein said means includes a pressure-sensitive adhesive.

10. The packet of claim 9, wherein said pressure-sensitive adhesive includes a peel-off release sheet so as to allow said pressure-sensitive adhesive to be pressed onto the toilet seat of the typical toilet when said peel-off release sheet is removed.

11. The packet of claim 1, wherein said moist wipe is fabricated out of a sheet of fibrous material.

12. The packet of claim 1, wherein said moist wipe includes a plurality of fold lines so as to allow said moist wipe to be folded up and fit into said second compartment of said enclosure.

13. The packet of claim 1, wherein said enclosure is flexible.

14. The packet of claim 8, wherein said means is disposed on a bottom surface of said sanitary toilet seat cover.

15. The packet of claim 4, wherein said tear line of said enclosure is across one of said peripheral edges of said first outer wall, said second outer wall, and said common partition wall.

16. The packet of claim 5, wherein said dry sheet protective paper of said sanitary toilet seat cover is rectangular; and wherein said dry sheet protective paper of said sanitary toilet seat cover has four beveled corners.

* * * * *